US006141833A

United States Patent [19]

Sørensen

[11] Patent Number: 6,141,833

[45] Date of Patent: Nov. 7, 2000

[54] PLANT FOR PRODUCING A NON-WOVEN FIBER PRODUCT

[75] Inventor: Birger Elmgaard Sørensen, Vejle, Denmark

[73] Assignee: M&J Fibretech A/S, Horsens, Denmark

[21] Appl. No.: 09/331,324

[22] PCT Filed: Dec. 17, 1997

[86] PCT No.: PCT/DK97/00578

§ 371 Date: Jun. 18, 1999

§ 102(e) Date: Jun. 18, 1999

[87] PCT Pub. No.: WO98/28480

PCT Pub. Date: Jul. 2, 1998

[30] Foreign Application Priority Data

Dec. 20, 1996 [DK] Denmark ..... 1491/96

[51] Int. Cl.[7] ..... D01G 25/00

[52] U.S. Cl. ..... 19/308; 19/161.1; 19/296

[58] Field of Search ..... 19/161.1, 163, 19/296–300, 301, 302, 303, 304, 305, 307, 308; 162/300, 301, 306; 198/689.1; 264/518; 425/80.1, 82.1, 83.1, 363, 371

[56] References Cited

U.S. PATENT DOCUMENTS 4,144,124 3/1979 Turunen et al. ..... 162/301
4,417,931 11/1983 Li ..... 264/518
4,483,745 11/1984 Wicks et al. ..... 162/205
4,668,322 5/1987 Christensen ..... 19/296
4,943,351 7/1990 Wedel ..... 162/306
5,414,902 5/1995 Kroyer ..... 19/305

*Primary Examiner*—John J. Calvert
*Assistant Examiner*—Gary L. Welch
*Attorney, Agent, or Firm*—Pennie & Edmonds LLP

[57] ABSTRACT

The invention relates to a plant for producing a non-woven, web-formed fiber product. The plant comprises a first forming wire with an inlet and outlet end and an upper part which, at the inlet end takes up a carded or air-laid layer of fiber and transports it to the outlet end. The plant also includes a roller with an upper and lower roller part for compressing the fiber layer, and a second wire, positioned above the first wire, with a lower part which extends across the roller, and a suction box which is placed above the roller. In the section (a) between the outlet end of the first forming wire and roller, the fiber layer is firmly sucked onto the under side of the lower part of the second wire via the suction box. The fiber layer is thus stabilized so that the plant can, at a considerably faster production speed than corresponding conventional systems, produce a non-woven, web-formed fiber product of high quality with an evenly distributed fiber density and uniform surface.

16 Claims, 7 Drawing Sheets

PLANT FOR PRODUCING A NON-WOVEN FIBER PRODUCT

FIELD OF THE INVENTION

The invention concerns a plant for producing a non-woven, web-formed fiber product, and is comprised of, a first endless forming wire having an inlet and an outlet end and a lower and an upper part, whereby the upper part of the first wire, at the inlet end, is picking up a carded or air-laid layer of fiber in operation and is transporting this layer to the outlet end of the wire; a roller with an upper and lower roller part for compressing the fiber layer; and a second endless wire having a lower and an upper part.

BACKGROUND ART

A wide variety of different fibers are used to produce fiber products, for example, cotton fiber, cellulose fiber, synthetic fiber, and combinations of these fibers.

In general, a loosely continuous layer of fibers is put on the forming wire with a card or a fiber distributor in a thickness of approximately, for example, 25 mm. From the forming wire, the fiber layer continues to a roller, where it is rolled into a thinner layer with a thickness of approximately, for example, 0.1 mm. This rolled down fiber layer then passes through one, or several rollers which, depending on type and application, warm and crosslink the fibers, roll on a pattern, and cool down the fiber layer.

There is an open section between the outlet end of the forming wire and the roller where the now freely hanging fiber layer is not supported. The layer must therefore be tightened in order for it to be sufficiently stabilized for being fed into the roller without break-downs or production faults occurring. This tightening means that the fiber layer is stretched and becomes thinner. However, the layer has a natural tendency to be stretched most in those areas where it is already thinnest. The structure of the finished product therefore varies in density and strength, and the surface appears uneven and blotchy. This means that the product cannot satisfactorily meet today's high quality requirements as with regard to the quality and appearance of such products.

Even if the fiber layer is stretched while it passes this open section, the freely hanging layer continues to be very unstable, and this lack of stability limits the production speed of conventional systems. There are thus no known systems of this type which can operate at production speeds of over 200 m/min.

The fiber layer has a large content of air which, during the compression process in the roller flows out via, amongst others, the freely hanging fiber layer. When the production speed exceeds a certain limit, the air flow has such a force that the relatively loosely connected fibers in the freely hanging fiber layer are not able to resist the air pressure sufficiently. In this case, the fiber layer could more or less be blown apart by the air, thus making further rolling difficult and reducing the quality of the finished product.

In order to rectify this drawback, attempts have been made to precompress the fiber layer already during transport on the wire by using a second wire, inclined towards the transport direction, and placed above the fiber layer of the first wire. The fiber layer is, in this way, successively pressed together between the two wires during transport to the outlet end of the first wire.

Such plants are known from U.S. Pat. No. 4,146,564 and U.S. Pat. No. 4,476,175. However, it has become apparent that after the purely mechanical compression in these plants, the fiber layer has a tendency to spring back into shape to such an extent when passing this open section, that the following heat treatment process for binding the fibers together has not been able to run satisfactorily.

SUMMARY OF THE INVENTION

The object of the invention is to provide a plant of the kind mentioned in the opening paragraph for producing a non-woven, web-formed fiber product of high quality and having an evenly distributed fiber density and a uniform surface, at a higher production speed than otherwise known today.

The novel and unique features whereby this is achieved, is the fact that the lower part of the second wire extends between the upper and lower roller part of the roller, that a suction arrangement is positioned above the lower part of the second wire, and that said lower part of the second wire extends at least to the outlet end of the first wire.

The differential pressure formed by this arrangement presses the fiber layer firmly up against the lower part of the second wire which thus acts as an effective support for the fiber layer while it runs between the outlet end of the forming wire and the roller. This means that the fiber layer now passes through this open section in a stable condition thus enabling the plant according to the invention to operate at much higher production speeds than corresponding conventional systems. Another advantage of this new plant is that the fiber layer is pre-compressed by the differential pressure above the fiber layer. This reduces its thickness, which means that it is easier for the fiber layer to be caught by the roller. The differential pressure also counteracts the damaging effect of the flowing air from the compressing process in the roller.

When the suction arrangement also extends at least between the outlet end of the first wire and the upper roller part of the roller, an optimal effect of the design is obtained as the fiber layer is supported throughout the entire distance between the outlet end of the first wire and the roller.

By allowing a section of the lower part of the second wire to extend over part of the fiber layer on the upper part of the first wire, the fiber layer can advantageously be precompressed during transport to the outlet end of the first wire.

According to one embodiment, the lower part of the second wire is allowed, during operation, to run at the same, or almost the same speed as the upper part of the first wire. This is an advantage when a fiber structure is required which has a trim corresponding to that of the fibers placed on the inlet end of the first wire.

According to another embodiment, the first and second wire part run at different speeds, which means that the fiber layer between the two wires is subjected to a carding type of process. This can even out the fiber structure and assist in the pre-compression of the fiber layer.

The suction arrangement above the lower part of the second wire can be a fixed suction box which, during operation, is evacuated by means of a vacuum source. This construction is very simple and inexpensive.

However, the suction arrangement can also be a rotating, perforated drum. The advantage of this arrangement is that the circumference of the drum can follow the lower part of the second wire so closely that the negative pressure in the drum can be optimally used to support the fiber layer.

As with conventional systems, the upper part of the roller can be a roll and this roll can advantageously be connected to a vacuum source during operation, and can have a perforated wall. The air which is pressed out of the fiber layer during the compression process is, to a great extent, sucked into the upper roller instead of blowing out and damaging the fiber layer in front of the roller.

The roller can entirely be made of an elastomer such as, for example, rubber. The roller can also, for example, be made of steel having an outer rubber coating. The elastomer is deformed elastically during the compression process by the reaction pressure from the fiber layer. When the roll turns past the compressing area, the elastomer is again straightened. Thereby, the fiber layer is loosened from the roll and can easily slip off the roll after passage.

As the fiber layer is supported and fed by the lower part of the second wire which, in operation, runs through the roller, a stationary, smooth rolling sheet can be used as the upper roller part instead of a roll. This rolling sheet is simple and inexpensive to produce and maintain.

When the sheet is perforated and extends underneath the suction arrangement, the fabric and thus the fiber layer is supported very effectively in the area between the outlet end of the first wire and the roller.

To promote the pre-compression of the fiber layer during transport on the upper part of the first wire, an additional suction box can be placed under the first wire. By allowing two suction boxes to overlap each other, air in the fiber layer is effectively sucked out, and at the same time a considerable pre-compression is obtained.

In an especially advantageous embodiment, the plant can include a third forming wire having an upper part which follows the underside of the lower part of the second wire along a section and at a distance above the roller. Between this section and the roller, a second suction arrangement can be positioned above the lower part of the second wire. With this design, the plant can be adapted for the production of two different products.

In one case, the fiber layer can, during operation, run around the lower roll of the roller and one or several subsequent treatment rollers and then be further transported by the third wire. In this way, the fiber layer is continuously supported. This means that the plant can be used for the production of fiber products which, at least during this part of the process, do not have any real strength and cohesion.

Another product can be of such a type that the fiber layer does not need to run around any separate treatment rolls. After the roller, the fiber layer is immediately sucked onto the under side of the lower part of the second wire. In this way, it is effectively supported until support is taken over by the upper part of the third wire.

BRIEF DESCRIPTION OF THE DRAWINGS

The invention will be explained in greater details below, describing only exemplary embodiments with reference to the drawings, in which.

DETAILED DESCRIPTION OF THE PREFERRED EMBODIMENTS

Figure 1:
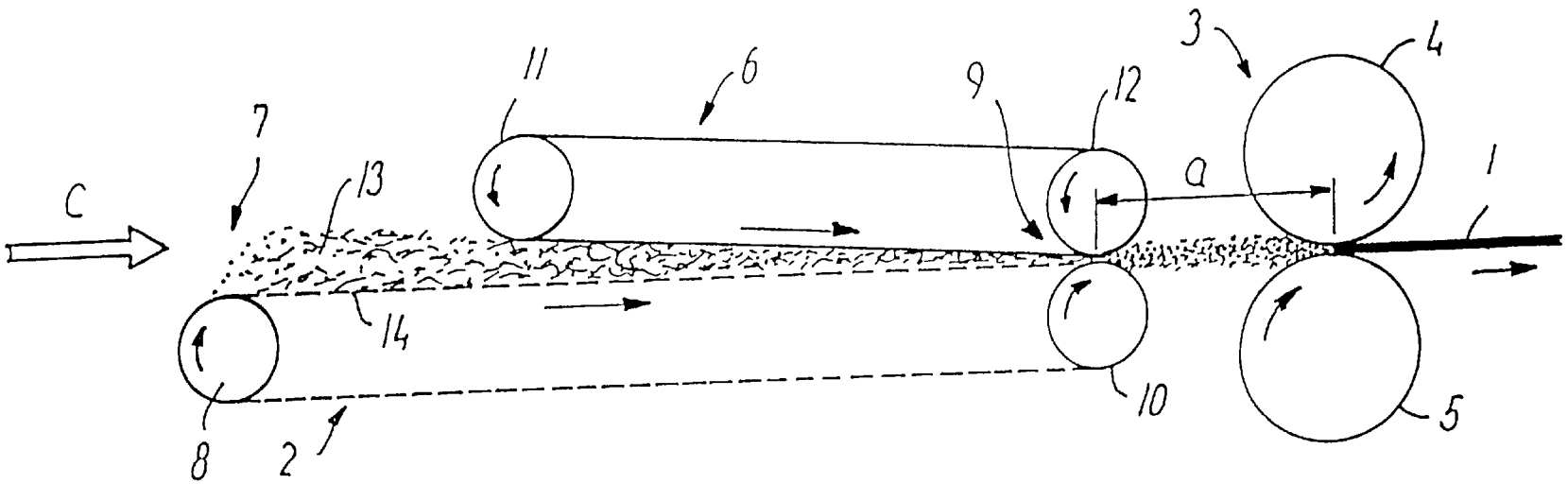
PRIOR ART FIG.1
FIG. 1 shows a conventional plant for producing a nonwoven, web-formed fiber product with a forming wire and a roller with an upper and lower roll.

FIG. 1 shows a conventional plant for producing a nonwoven, web-formed fiber product 1. In principle, the plant comprises a forming wire 2 and a roller 3 which comprises upper and lower rotational rolls 4, 5. These are placed at a distance from each other which, in the main, corresponds to the required thickness of the finished product 1. During operation, the forming wire and the rolls run in the direction indicated by the arrows. In the example shown, there is also a pre-compression wire 6 positioned above the first wire at a downwards inclination in relation to the transport direction of the first wire.

In operation, the forming wire 2 runs at an inlet end 7 over a roller 8, and at an outlet end 9 over a second roller 10. The pre-compression wire 6 runs over a first roll 11 positioned in an area between the inlet and outlet ends of the forming wire, and a second roll 12 at the outlet end of the forming wire.

When the plant is in operation, a card (symbolized with the arrow C in the drawing) applies a layer of loose fibers 13 onto the upper part 14 of the forming wire at the inlet end 7. It should be noted that other methods can, within the scope of the invention, be used to apply the fibers to the forming wire, for example, it can be air-laid using a fiber distributor.

The geometry of respectively roller rolls 4, 5 and the wire rolls 10,12 means that there is, between the outlet end 9 of the forming wire and the roller 3, an open section (a) which provides no support for the fiber layer. When passing this section, the fiber layer therefore hangs down freely between the outlet end of the forming wire and the roller. At the same time, it moves at a relatively high speed under the influence of the air resistance from the surrounding air. During the compression process in the roller, air is also pressed out of the fiber layer. This air blows with considerable force across the freely hanging fiber layer and this, together with the air resistance, causes the fiber layer to shake. When the speed exceeds a limit of between 100 and 200 m/min, the fiber layer shakes so much that its passage in the roller becomes erratic and incidental. This can cause operational failures and faulty production.

In order to stop this shaking, the freely hanging fiber layer is tightened by making the roller run slightly faster than the forming wire. This means that the thin areas of the fiber layer become even thinner, giving the final product a poor quality. The density and strength of the product become irregular and its surface blotchy.

The expelled air from the compression process in the roller flows, amongst others, into the freely hanging fiber layer which thus is blown up into a thicker and looser continuous layer with an increased tendency to shake.

The gap between rolls 4, 5 of roller 3 is often very narrow. Systems of this type are used, amongst others, for the production of fiber products having a thickness of about, for example, 0.1 mm. It is naturally very difficult to introduce a 25 mm fiber layer into a gap which is designed for very thin products, and therefore, in the example shown, the thickness of the fiber layer is reduced in advance during transport on the forming wire using the pre-compression wire 6. After being compressed in this way, the fiber layer has a tendency to spring back into shape when passing the open section between the forming wire and the roller. This means that the advantage of pre-compressing the fiber layer is partially lost.

Figure 2:
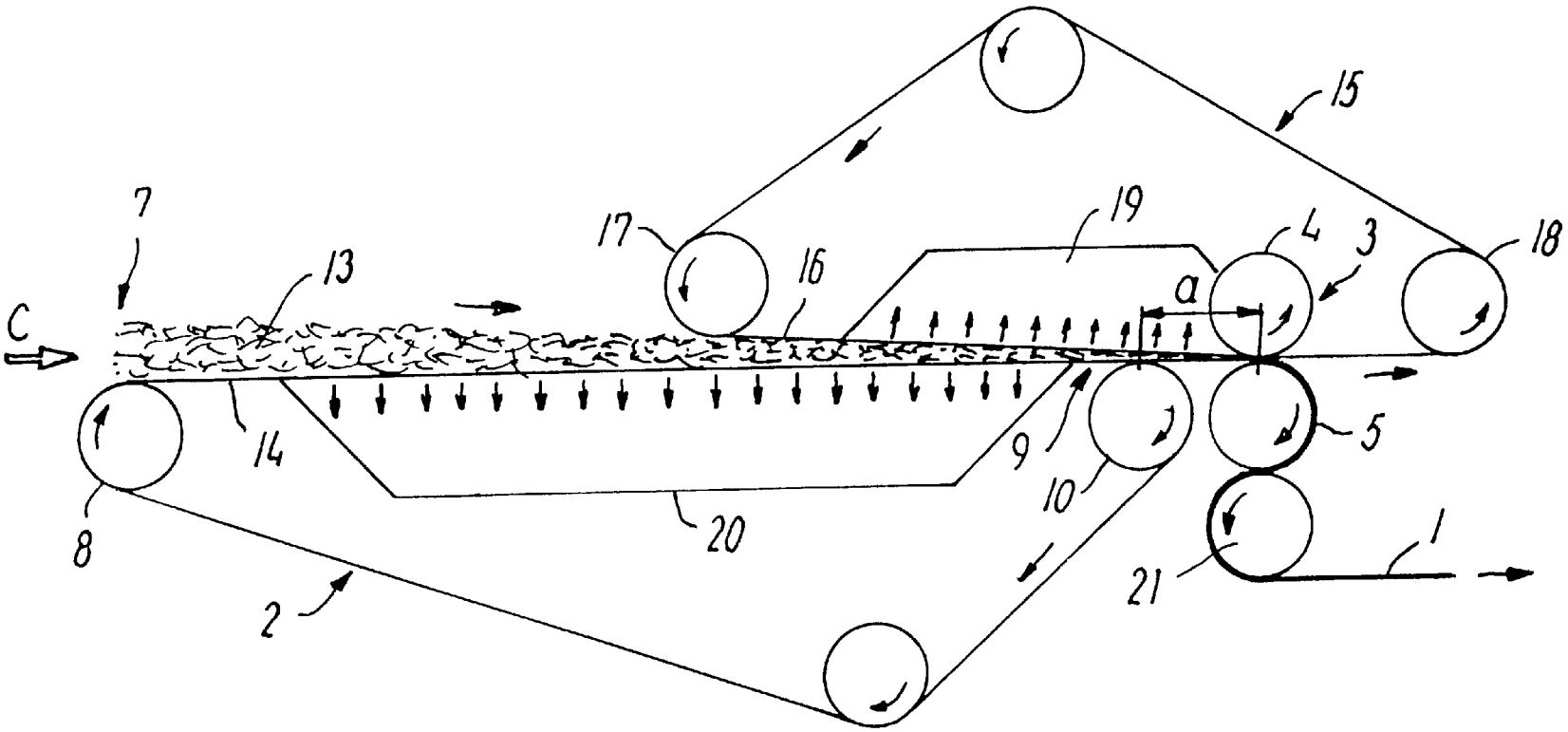
FIG. 2 shows a first embodiment of a plant according to the invention which has a first forming wire and a second forming wire with a suction box, together with a roller having an upper and lower roll.

FIG. 2 shows a first embodiment of the plant according to the invention. Basically, this plant is built up in the same way as the plant shown in FIG. 1, which means that the parts used in both of the systems have been given the same reference number.

In addition to the forming wire 2, which in the following will be called the first wire 2, is a second wire 15 with a lower part 16 which, along a section, abuts on the upper side of fiber layer 13. The second wire 15 runs over a first roll 17 positioned in an area above the first wire 2 and a second roll 18 positioned after the roller 3. During operation, the part 16 runs right across the gap between the two rolls 4 and 5 of the roller. In addition, a suction box 19 is placed above the lower part 16 of the second wire. During operation, this box is connected to a vacuum source (not shown). A second suction box 20 which, during operation is connected to a vacuum source (not shown), is placed under the upper part 14 of the first wire. The two suction boxes overlap each other.

In principle, the plant works in the same way as the conventional plant shown in FIG. 1. A card C places a fiber layer 13 on the first wire 2 at the inlet end 7, after which the wire transports the fiber layer towards the outlet end 9. The second wire inclines downwards in the transport direction and therefore functions, in this section, as a pre-compression wire. The pre-compression process is promoted by sucking air out of the fiber layer by means of the suction boxes 19 and 20.

The suction box 19 positioned above the lower part 16 of the second wire, is extending to the upper roll 4 of the roller and thus over the open section between the first forming wire 2 and the roller 3. When passing this section, the fiber layer is firmly pressed up towards the under side of the lower part of the second wire by the pressure differential between the pressure in the suction box and the pressure of the surrounding air. In this way, the fiber layer is effectively supported, thus eliminating the disadvantage of the conventional plant mentioned above and illustrated in FIG. 1.

The fiber layer now no longer needs to be stretched in order to avoid shaking and the finished product is therefore of a high quality. In addition, the expansion of the fiber layer in the open section is counteracted by the outer effect of the differential pressure on the surface of the fiber layer and the continuous fiber layer is safely guided into the roller gap. This means that operational failure and faulty production are no longer likely to occur.

The lower roll 5 of the roller can be designed as a heat roll which can heat the product 1, thus crosslinking its fibers. In the example shown in FIG. 2, the product 1 subsequently runs around a third roll 21 which, for example, can be a patterned roll (not shown). In other cases, additional rolls can be added (not shown) which, in themselves, treat the product in a manner known per se.

Figure 3:
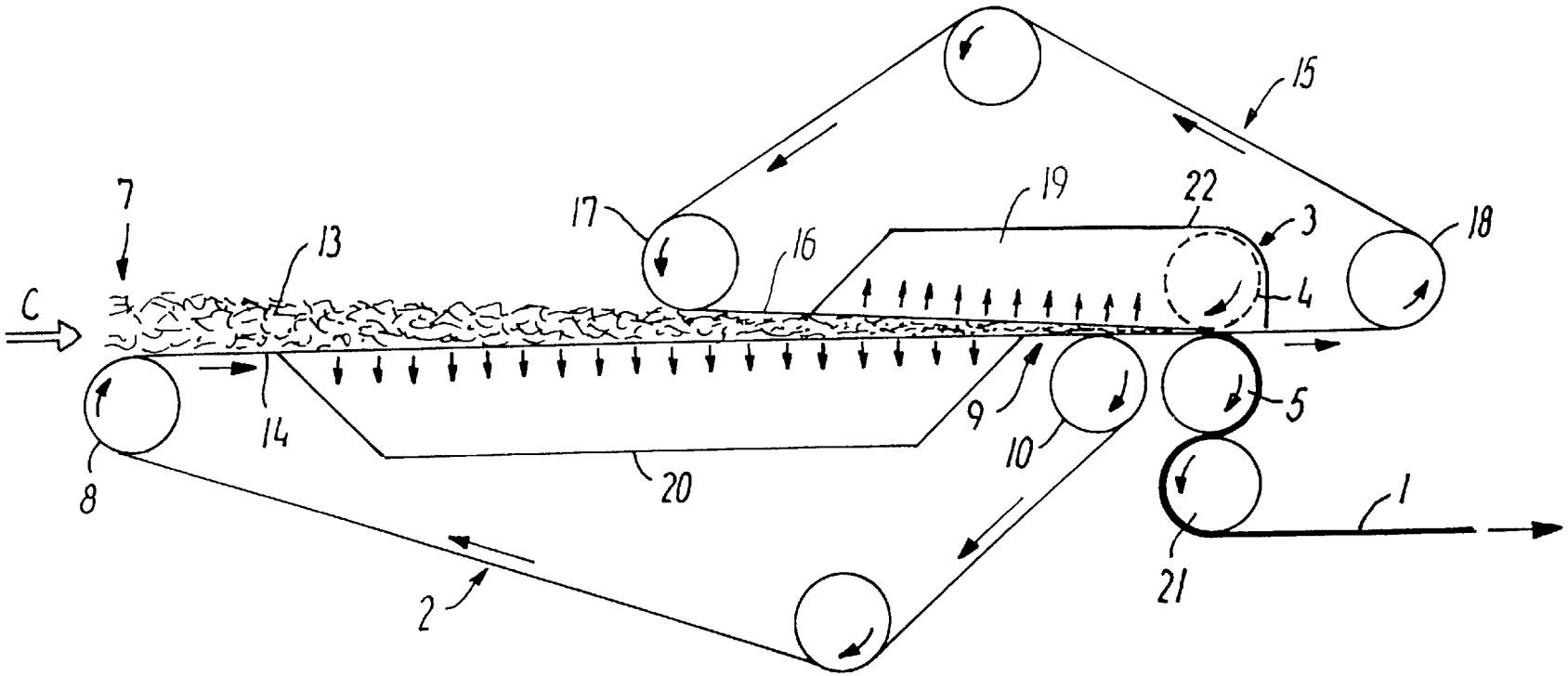
FIG. 3 shows a second embodiment of a plant according to the invention which has a first forming wire and a second forming wire with a suction box, together with a roller with an upper, perforated roll and a lower roll.

FIG. 3 shows a second embodiment of the plant according to the invention. In all respects but one, this design corresponds to that shown in FIG. 2 and will therefore not be described in further detail here. The one aspect which differs is that the upper roll 22 of roller 3 now has a perforated wall and is connected to a vacuum source (not shown) during operation. The advantage of this design is that it sucks up the air which is forced out of the fiber layer when it is compressed in the roller. In this way, the air does not disturb the incoming fiber layer. As shown, the suction box 19 is extending right across the perforated roll 22, and thus can also be evacuated via the suction box.

Figure 4:
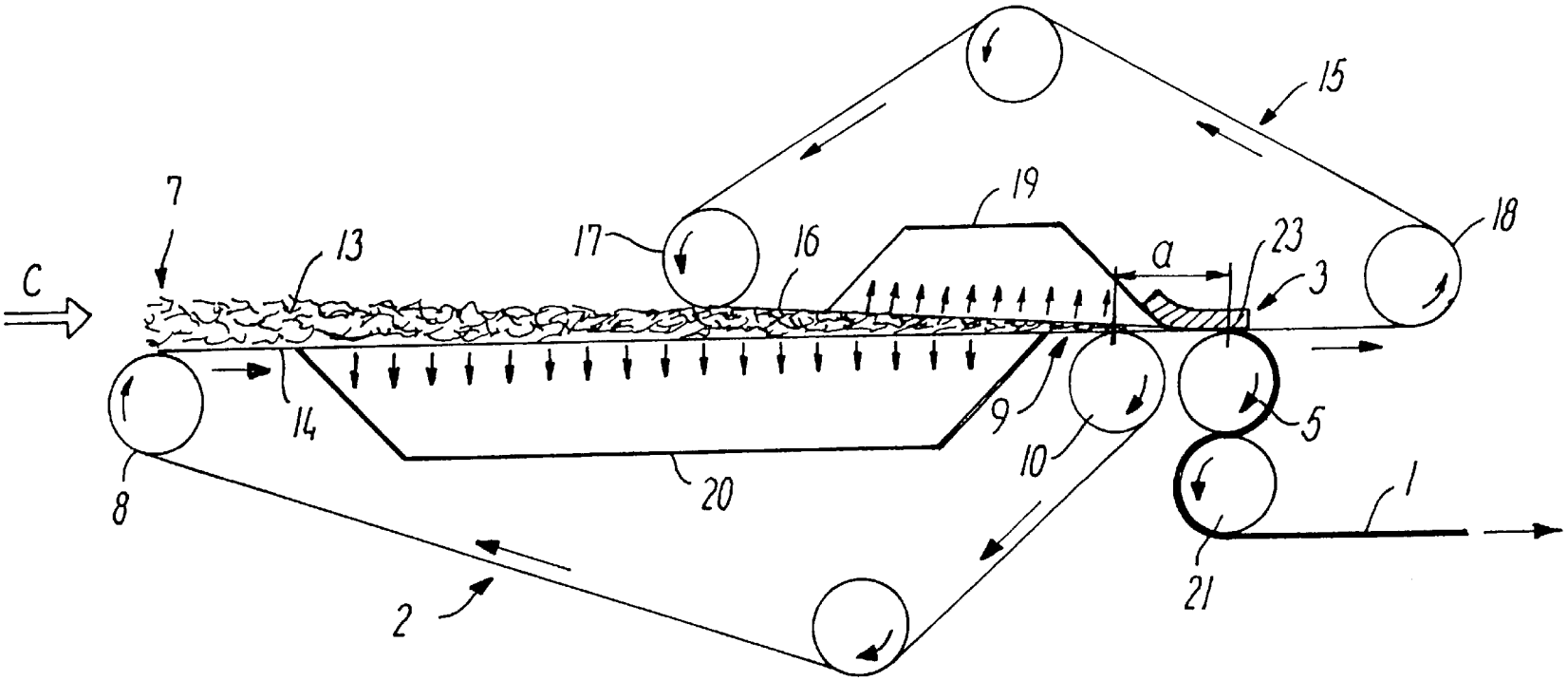
FIG. 4 shows a third embodiment of a plant according to the invention which has a first forming wire and a second forming wire with a suction box, together with a roller with an upper stationary rolling sheet and a lower roll.

FIG. 4 shows a third embodiment of the plant according to the invention. This version also corresponds to the version shown in FIG. 2. In this case, the upper roll of the roller has, however, been replaced by a smooth rolling sheet 23. The reason why it is now possible to use a stationary plate in this way, instead of a rotating roll is that the lower part 16 of the second wire serves for feeding the fiber layer while it passes the roller 3. This design is very inexpensive and reliable.

Figure 5:
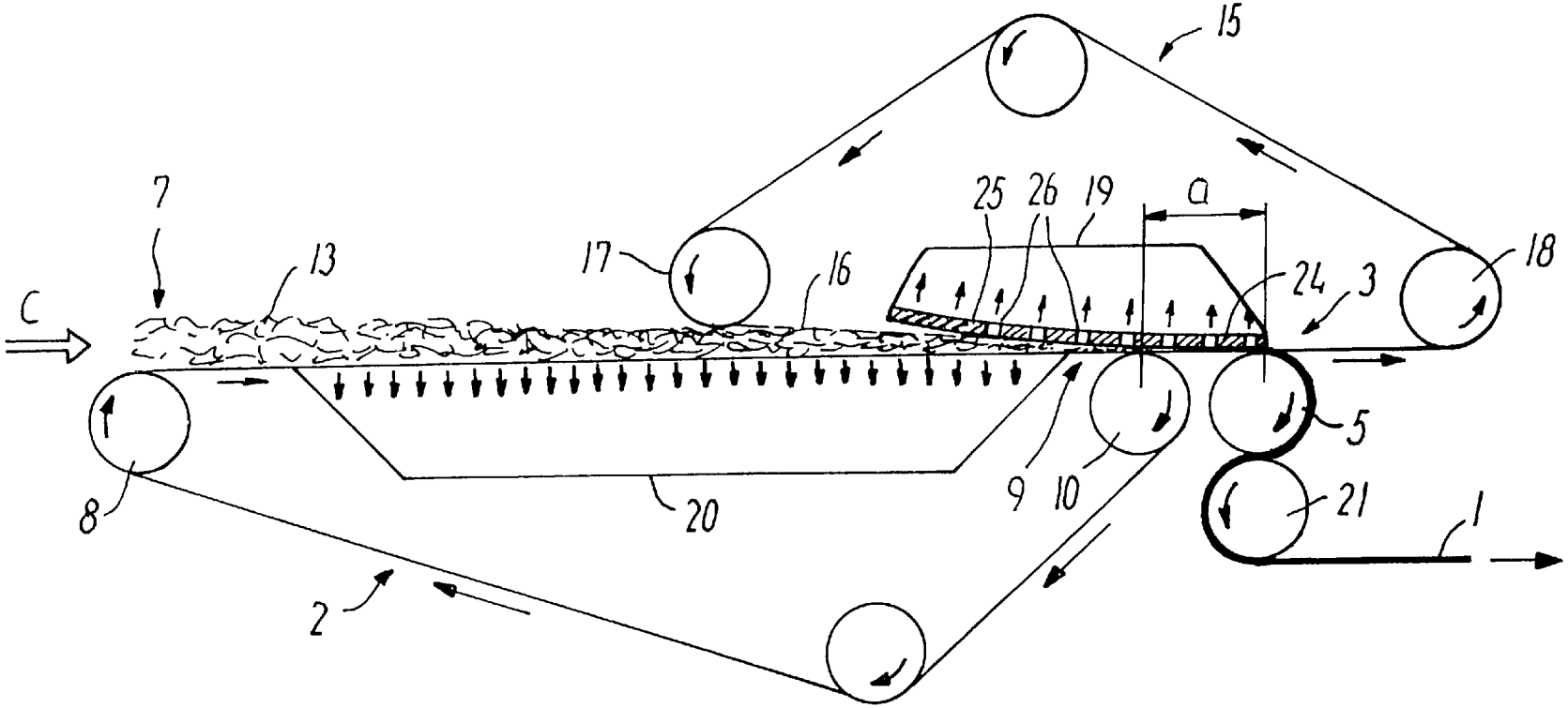
FIG. 5 shows a fourth embodiment of a plant according to the invention which has a first forming wire and a second forming wire with a suction box, together with a roller with an upper, stationary rolling sheet extending in under the suction box, and a lower roll.

FIG. 5 shows a corresponding fourth embodiment of the plant according to the invention with a variation 24 to the rolling sheet 23 shown in FIG. 4. In this case, the rolling sheet 24 is however extending with an extension 25 under the suction box 19, and is therefore equipped with a number of holes 26. These holes allow the negative pressure in the suction box to be transmitted down to the upper side of the fiber layer. The extended rolling sheet supports advantageously the lower part 16 of the second wire before and during the passing of the open section between the first wire 2 and roller 3, thus ensuring the effective stabilization of the fiber layer during this phase.

Figure 6:
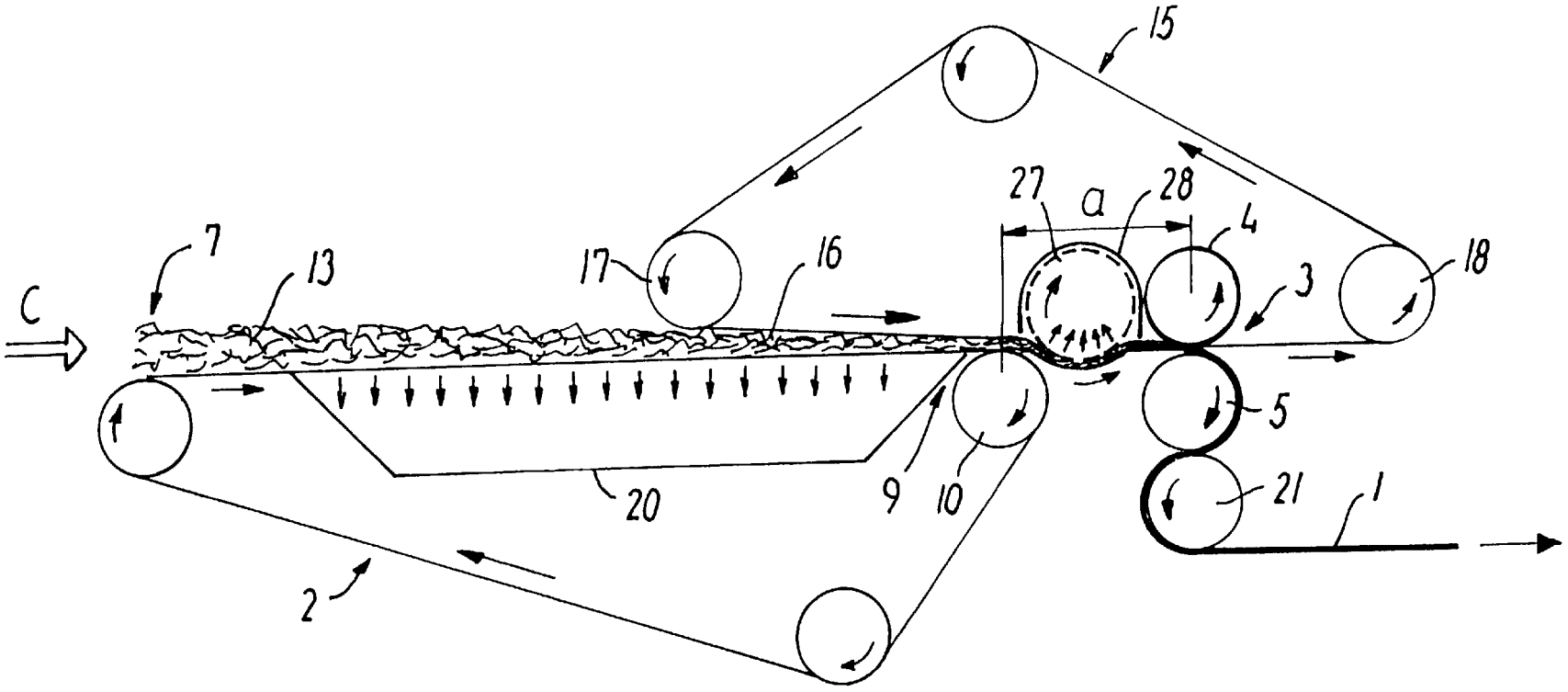
FIG. 6 shows a fifth embodiment of a plant according to the invention which has a first forming wire and a second forming wire with a suction arrangement in the form of a perforated drum, together with a roller having an upper and lower roll.

FIG. 6 shows the fifth embodiment of the plant according to the invention which corresponds to that shown in FIG. 2. However, instead of a suction box 19 a rotating drum 27 is used during operation which, along the circumference runs at the same speed as the lower part 16 of the second wire and in close contact with it. There is a screen 28 around the drum 27. This design distinguishes itself in that it prevents the drum, via the gap between the transition to the fiber layer, from filling with air which could prevent the necessary negative pressure in the drum from building up.

Figure 7:
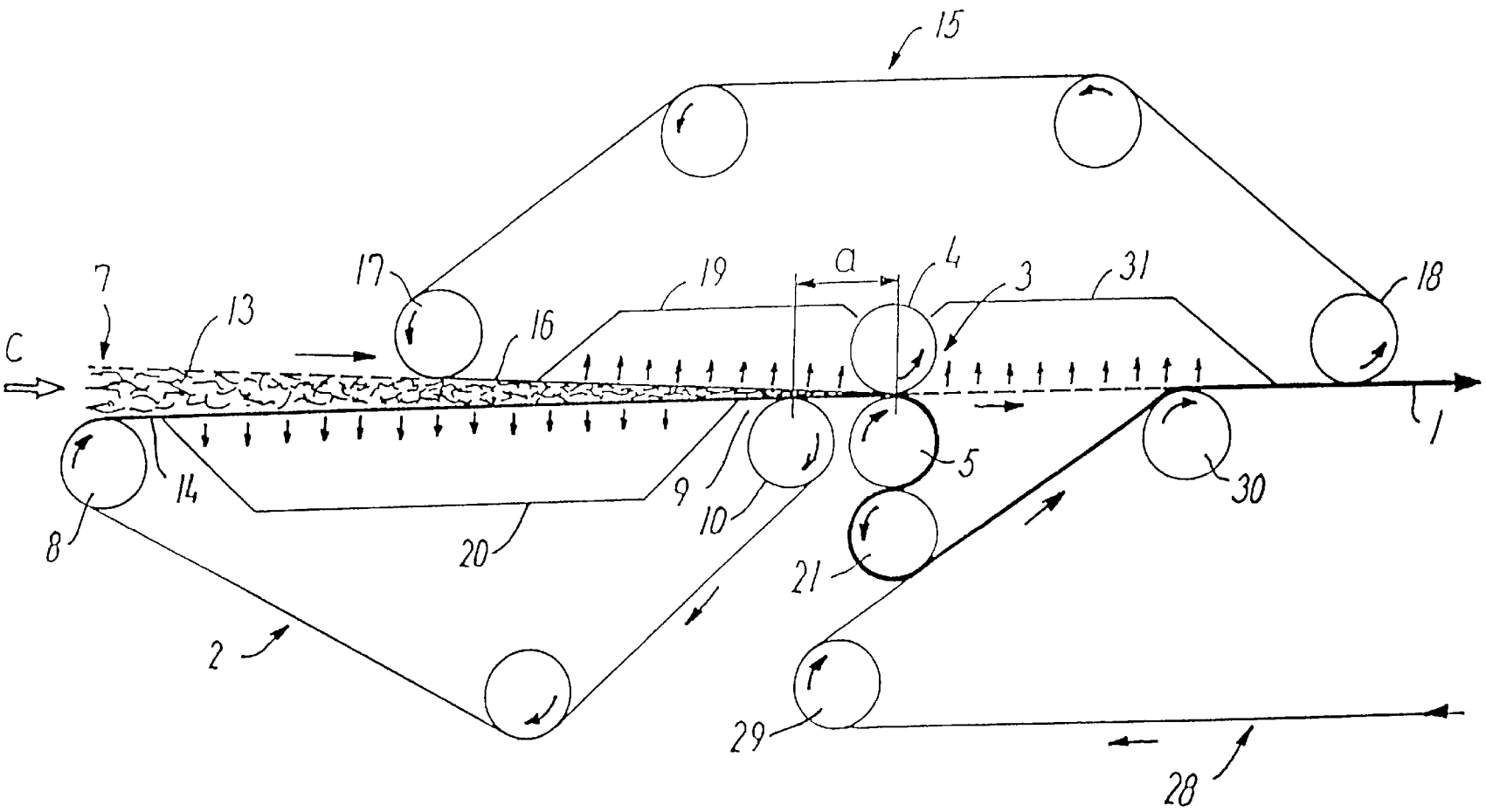
FIG. 7 shows a sixth embodiment of a plant according to the invention which has a first forming wire, a second forming wire with a suction box and a third forming wire with a suction box, together with a roller with an upper and lower roll.

FIG. 7 shows the sixth embodiment of the plant according to the invention. This also corresponds to the plant shown in FIG. 2, but in this case, an underlying third wire 28 is added which runs over a number of rollers of which the figure only illustrates a first roller 29 and a second roller 30.

In this embodiment, the plant can function in two different ways which can be selected to suit the character of the fiber product used.

A solid line shows how a fiber product 1 passes the roller 3, runs around its lower roll 5, and further around another roll 21, for example a patterned roll, for then to be supported by the third wire 28 and transported around the second roll 30 and further on wire 28 in the direction of the arrow. As the product is supported at all times during this process, this function method is especially good for relatively weak fiber products.

Using another function method, the fiber product 1 can also pass straight out after roller 3, without having to run round other rolls, as shown by the dotted line in FIG. 7. With regard to supporting the fiber product over the section between roller 3 and the second roller 30 of the third wire, there is, above the lower part 16 of the second wire, a third suction box 31 which, during operation, is connected to a vacuum source (not shown) and which sucks the fiber product firmly to the under side of wire web 16.

What is claimed is:

1. A plant for producing a non-woven, web-formed fiber product comprising:

a first endless forming wire having an inlet and an outlet end and a lower and an upper part, configured such that the upper part of the first wire, at the inlet end, picks up a carded or air-laid layer of fiber in operation and transports the layer to the outlet end of the first wire, a roller with an upper and lower roller part for compressing the fiber layer and at the same time pressing air out of the fiber layer, a second endless wire having a lower and an upper part, wherein the lower part of the second wire extends between the upper and lower roller part of the roller and the lower part of the second wire extends at least to the outlet end of the first wire;

a first suction arrangement positioned above at least a portion of the lower part of the second wire; and a second suction arrangement overlaps at least a portion of the first suction arrangement and is located under at least a portion of the upper part of the first wire.

2. A plant according to claim 1, wherein the first suction arrangement over the lower part of the second wire extends at least between the outlet end of the first wire and the upper roller part of the roller.

3. A plant according to claim 1, wherein a section of the lower part of the second wire extends across part of the fiber layer on the upper part of the first wire.

4. A plant according to claim 3, wherein a section of the lower part of the second wire is positioned above the first wire at a downwards inclination in relation to a transport direction, such that said section of the lower part of the second wire compresses the fiber layer and at the same time presses air out of the fiber layer.

5. A plant according to claim 1, wherein, in operation, the lower part of the second wire substantially runs at about the same speed as the upper part of the first wire.

6. A plant according to claim 1, wherein, in operation, the lower part of the second wire runs at a different speed than the upper part of the first wire.

7. A plant according to claim 1, wherein the first suction arrangement above the lower part of the second wire comprises a first suction box which, during operation, is connected to a vacuum source, and the second suction arrangement comprises a second suction box that during operation is connected to a vacuum source.

8. A plant according to claim 1, wherein the first suction arrangement above the lower part of the second wire comprises a rotating perforated drum which, in operation, is connected to a vacuum source.

9. A plant according to claim 1, wherein the upper part of the roller is a roll which has a perforated wall and which, during operation, is connected to a vacuum source.

10. A plant according to claim 1, wherein the upper part of the roller is a roll made of an elastomer or of a material which has an outer coating of at least an elastomer.

11. A plant according to claim 1, further comprising a third forming wire with an upper part which follows a portion of the lower part of the second wire along a section thereof and at a distance from the roller, and a third suction arrangement is located between the section of the second wire and the roller, and positioned above the lower part of the second wire.

12. A plant for producing a non-woven. web-formed fiber product comprising:

a first endless forming wire having an inlet and an outlet end and a lower and an upper part, configured such that the upper part of the first wire, at the inlet end picks up a carded or air-laid layer of fiber in operation and transports the layer to the outlet end of the first wire;

a roller with an upper and lower roller part for compressing the fiber layer;

a second endless wire having a lower and an upper part wherein the lower part of the second wire extends between the upper and lower roller part of the roller and the lower part of the second wire extends at least to the outlet end of the first wire; and a first suction arrangement positioned above at least a portion of the lower part of the second wire, wherein the upper part of the roller is a stationary, smooth sheet.

13. A plant for producing a non-woven, web-formed fiber product comprising:

a first endless forming wire having an inlet and an outlet end and a lower and an upper part, configured such that the upper part of the first wire, at the inlet end, picks up a carded or air-laid layer of fiber in operation and transports the layer to the outlet end of the first wire;

a roller with an upper and lower roller part for compressing the fiber layer;

a second endless wire having a lower and an upper parts wherein the lower part of the second wire extends between the upper and lower roller part of the roller and the lower part of the second wire extends at least to the outlet end of the first wire; and a first suction arrangement positioned above at least a portion of the lower part of the second wire, wherein the upper part of the roller is a perforated sheet extending underneath the first suction arrangement.

14. A plant for producing a non-woven, web-formed fiber product comprising:

a first endless forming wire having an inlet and an outlet end and a lower and an upper part, configured such that the upper part of the first wire, at the inlet end, picks up a carded or air-laid layer of fiber in operation and transports the layer to the outlet end of the first wire;

a roller with an upper and lower roller part for compressing the fiber layer;

a second endless wire having a lower and an upper part, wherein the lower part of the second wire extends between the upper and lower roller part of the roller and the lower part of the second wire extends at least to the outlet end of the first wire;

a first suction arrangement positioned under at least a portion of the upper part of the first wire; and a second suction arrangement positioned above at least a portion of the lower part of the second wire between the outlet end of the first wire and the roller, wherein said second suction arrangement is provided by a rotating, perforated drum that is connected to a vacuum source.

15. A method for producing a non-woven, web-formed fiber product comprising:

carding or air-laying a layer of loose fibers on a first endless forming wire having an inlet and an outlet end and a lower and an upper part and transporting this layer in a transport direction to the outlet end of the first wire;

pre-compressing the fiber layer and at the same time pressing air out of the layer between the upper part of the first endless forming wire and a section of a lower part of the second wire, which section is positioned above the first wire;

transferring the pre-compressed fiber layer from the upper part of the first wire to the lower part of the second endless wire;

compressing the fiber layer placed on the lower part of the second endless wire and at the same time pressing more air out of the fiber layer in a roller with an upper roller part placed above and a lower roller part placed underneath the lower part of the second endless wire;

suctioning the fiber layer against the underside of the lower part of the second endless wire simultaneously with suctioning air out of the fiber layer by means of a first suction arrangement placed above the lower part; and suctioning air out of the fiber layer placed on the upper part of the first endless forming wire by means of a second suction arrangement that overlaps the first suction arrangement of the second wire and which is placed underneath the upper part of the first wire.

16. The method of claim 15, wherein the section of the lower part of the second wire that is positioned above the first wire during the precompressing step is downwardly inclined in relation to the transport direction.

* * * * *